US007076807B2

(12) United States Patent
Bergkvist

(10) Patent No.: US 7,076,807 B2
(45) Date of Patent: Jul. 18, 2006

(54) CHILD'S BIB THAT INCLUDES A BEAD STRING FASTENER

(75) Inventor: Håkan Bergkvist, Bromma (SE)

(73) Assignee: Baby Bjorn AB, Danderyd (SE)

( * ) Notice: Subject to any disclaimer, the term of this patent is extended or adjusted under 35 U.S.C. 154(b) by 0 days.

(21) Appl. No.: 10/530,659

(22) PCT Filed: Oct. 29, 2003

(86) PCT No.: PCT/SE03/01672

§ 371 (c)(1),
(2), (4) Date: Apr. 7, 2005

(87) PCT Pub. No.: WO2004/041009

PCT Pub. Date: May 21, 2004

(65) Prior Publication Data

US 2006/0000002 A1 Jan. 5, 2006

(30) Foreign Application Priority Data

Nov. 6, 2002 (SE) ..... 0203259

(51) Int. Cl.
*A41B 13/10* (2006.01)

(52) U.S. Cl. ..... 2/49.1; 2/52

(58) Field of Classification Search ..... 2/49.1–49.5, 2/52, 48, 50, 51, 46, 336, 337, 341; 24/116 A, 24/127, 66.13, 9, 114.5, 594.11, 16 PB, 585.11, 24/591.1

See application file for complete search history.

(56) References Cited

U.S. PATENT DOCUMENTS

| | | | | | |
|---|---|---|---|---|---|
| 1,504,761 | A | * | 8/1924 | Hubbell | 24/116 A |
| 1,551,829 | A | * | 9/1925 | Maxwell | 24/299 |
| 2,592,696 | A | * | 4/1952 | Hoody | 446/490 |
| 2,820,269 | A | * | 1/1958 | Wolff | 24/9 |
| 2,845,672 | A | * | 8/1958 | Molene | 24/116 R |
| 2,884,638 | A | * | 5/1959 | Ream | 2/48 |
| 2,893,089 | A | * | 7/1959 | Bacon | 24/116 A |
| 3,094,754 | A | * | 6/1963 | Wayne | 24/116 R |
| 3,172,178 | A | * | 3/1965 | Copell | 24/3.13 |
| D216,291 | S | * | 12/1969 | Korshak | D2/864 |
| 3,693,634 | A | * | 9/1972 | Gilbert | 132/212 |
| 4,262,391 | A | * | 4/1981 | Peash | 24/18 |
| 5,433,088 | A | * | 7/1995 | Mahar | 63/12 |
| 6,363,530 | B1 | * | 4/2002 | Lampson et al. | 2/49.1 |
| 6,481,016 | B1 | * | 11/2002 | Rees | 2/49.1 |
| 2005/0028239 | A1 | * | 2/2005 | Rees | 2/49.1 |

* cited by examiner

*Primary Examiner*—Amy B. Vanatta
(74) *Attorney, Agent, or Firm*—Jacobson Holman PLLC

(57) ABSTRACT

A child's bib includes a plastic string (5, 55, 56) which has a free-bearing part (55, 56) that extends from one end of the edge of the neck-surrounding recess of the bib to the front piece thereof and terminating in the proximity of the other end of the edge of said recess, said plastic string having the form of a series of beads (51) that are mutually separated by waist portions. Located at the free end portion of the string is a fastener (30) in the form of a rounded button which includes a notch-like recess (32) that receives the string and that has a restraining element (33, 34) which engages a waist portion (52) situated between two beads (51) in the string (56). The fastener is slightly undercut so as to be able to hold the string firmly with a limited force.

10 Claims, 1 Drawing Sheet

CHILD'S BIB THAT INCLUDES A BEAD STRING FASTENER

This is a nationalization of PCT/SE03/001672 filed Oct. 29, 2003 and published in English.

The present invention relates to a bib of the kind defined in the preamble of claim 1.

The bib according to the invention is of the kind known in practice that comprises a thin, resilient, injection-moulded plastic element that forms a bib front piece which is intended to cover the wearer's chest in the region beneath his or her neck and which has at its lower end a collecting tray and at its upper end a recess that is placed around the child's neck. A string of material of round cross-section is fitted to and around the edge of the recess.

It is also known in practice to connect a string to one end region of the edge of the recess and to allow the string to extend across the recess to a fastener on the upper part of the front piece in the region of the other end of the recess. The string is free-bearing and has the form of a series of beads which are mutually connected by means of waist portions. The fastener has the form of a keyhole opening that includes a first part whose size allows the pearls to pass through, and a radially and outwardly extending slot whose width corresponds to the diameter of the waist portions.

One object of the invention is to provide a fastener which enables the free end portion of the string to be attached more easily and which has the form of a series of mutually joined beads and enables the free end of the string to be fastened to and released from the fastener single handed.

Another object of the invention is to provide a fastener that minimises the risk of personal injury and that enables the holding strength of the string to be controlled within chosen limits with respect to the tension in the string.

These objects are achieved with the present invention.

The invention is defined in the accompanying independent claim 1.

Further embodiments of the invention will be evident from the accompanying dependent claims.

The string bridging the neck surrounding recess has the form of a string of beads, at least at its free end. An important feature of the invention is that the fastener has the form of a body that is mounted on the front piece and that includes a generally U-shaped notch, which preferably extends parallel with the nearby free end portion of the string. The notch faces away from the main surface of the body-carrying front piece and has a width corresponding to the diameter of the string. The notch includes a restraining element that is intended to be received in a waist between two mutually adjacent beads in the string. The restraining element preferably includes sections for springy and yielding engagement with the waist portions, said sections being mutually spaced apart at a distance smaller than the diameter of respective waist portions and located above the level of the centre of the string resting on the bottom of the recess.

The restraining element will preferably extend around the waist portion through more than 180 degrees.

The fastener body has generally the form of a hemispherical element whose height is suitably slightly larger than the outer diameter of the string so as to enable the notch to receive the whole of the string. The body is suitably located on the side of the front piece that faces away from the wearer.

The invention will now be described by way of example with reference to the accompanying drawing, in which FIG. 1 is a front view of a child's bib constructed in accordance with the invention;

Figure 1:
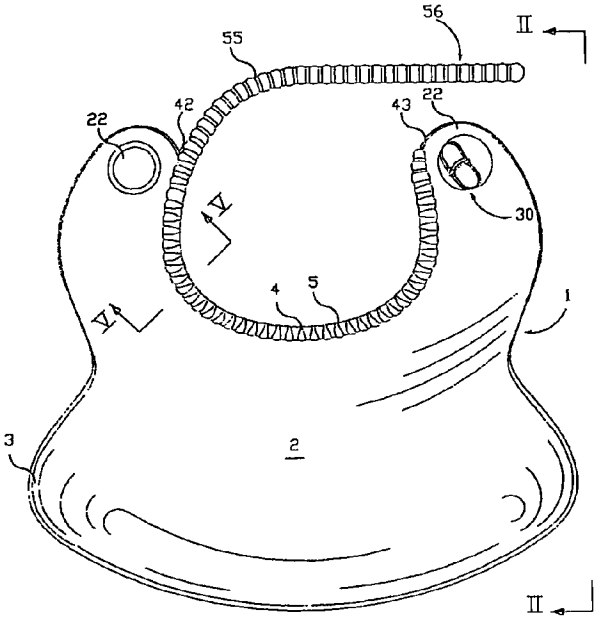
Figure 2:
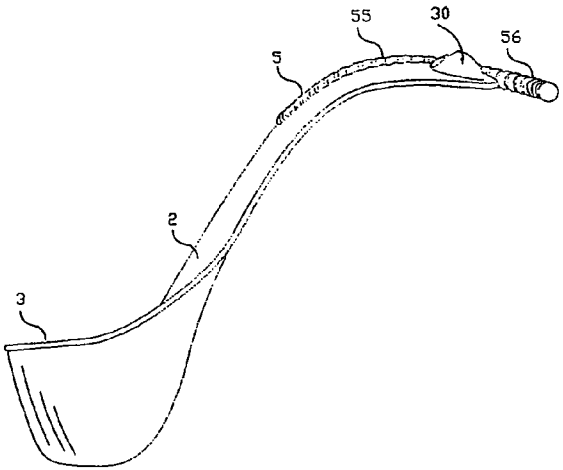
FIG. 2 is a side view taken on the line II—II in FIG. 1.

Shown in FIG. 1 is a bib 1 that comprises a thin injection-moulded plastic element that forms a bib front piece 2 which has at its lower end a tray-like projection 3 and at its upper end a recess 4 for placement around the child's neck.

A string of material 5 of round cross-section is fitted to and around the edge 41 of the recess 4.

Because the string 5 is comprised of a string of beads 51 that are mutually joined by waist portions 52, the string 5 will afford soft but nevertheless airy contact with the skin of the wearer's neck. As will be evident from FIG. 1, the string 5 includes an extension 55 in addition to the string portion moulded around the edge of the recess 4, said extension following generally a curved path from one end 42 of the recess 4 in a free-bearing manner with a free end-portion 56 of the extension located in a part 22 of the front piece 2 situated in the proximity of the other end 43 of the edge of the recess 4. A fastener 30 for fastening the end portion 56 of the string is provided in this region of the front piece 2. Provided in the upper end portion of the front piece 2 in the vicinity of the end 42 of the recess 4 is a penetrating opening 22 which enables the bib to be hung up.

Figure 3:
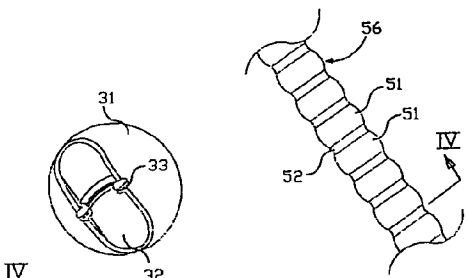
FIG. 3 is an enlarged view of part of the bib construction shown in FIG. 1.
Figure 4:
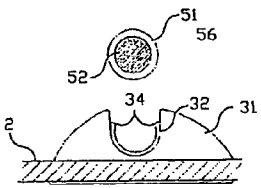
FIG. 4 is a sectioned view taken on the line IV—IV in FIG. 3.
Figure 5:
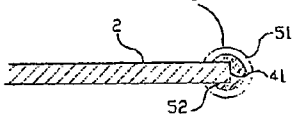
FIG. 5 is a sectioned view taken on the line V—V in FIG. 1.

The fastener 30 of the embodiment shown in FIGS. 3 and 4 has the form of a generally hemispherical body 31 whose curved part faces away from the front surface of the front piece 2. Extending through the body 31 is a notch 32 which has a width corresponding to the outer diameter of the beads 51 in the string 5 and a depth which corresponds generally to the diameter of said beads 51.

Provided midway along the notch 32 is a restraining element 33 which is intended to be received in a waist portion 52 and therewith secure the string against displacement along the notch 32.

As will be seen from FIG. 4, the restraining element 33 includes two mutually opposite parts 34 which are mutually spaced by a distance smaller than the diameter of a respective waist portion and which are located at or above the level of the centre of the string when the beads 51 of the string extension rest on the bottom of the notch 32, such that the notch 32 and said notch parts 34 will enclose the string around an angle slightly greater than 180 degrees.

The free end part of the string has a given bending resistance, such as to enable the end part of the string to be lifted up out of the notch 32 against the holding action afforded by the parts 34. This can be achieved by lifting the end part 56 of the string through a given distance from the body 31 and/or by wedging a finger between the front piece 2 and the string portion 56 in the proximity of the body 31. It will be seen from FIG. 4 that the body 31 has a shaft which extends through a hole (not shown) in the front piece 2. There is included a conical latching element anchored (by casting) between the end of the shaft and the rear side of the front piece 2. The rounded shape of the body 31 lessens the risk of the string hooking fast. Under normal circumstances the string portion 56 can be placed easily in the notch 32, by pressing the string 56 down into the notch with the thumb of one hand while supporting against the underside of the front piece at the fastener 30 with the fingers. Because the free-bearing part 55 of the string is pre-formed to bridge the entrance to the recess 4, the bib can be placed comfortably around a child's neck single handed. When the bib has been placed around the neck of a child, the elastically resilient part of the string will assist in holding the bib in place prior to snapping the string part 56 into the fastener 30.

The invention claimed is:

1. A bib that comprises a front piece (2) which has at its lower end a collecting tray (3) and at its upper end a recess (4) for placement of the bib about the wearer's neck, wherein a springy, free-bearing string (5), connected to the front piece in the region of one end of the edge of the recess (4), is adapted to extend to a fastener located on the upper part of the front piece (2) in the region of the other end of the recess (4), wherein the string comprises, at least in its free end portion, mutually sequential beads (51) that are joined together via waist portions (52), characterized in that the fastener includes a body (31) mounted on one major surface of the front piece (2); in that the body (31) includes a generally U-shaped notch (32) that extends generally parallel with the nearby end portion (56) of the free-bearing string; in that the notch (32) faces away from the front piece surface on which the body (31) is mounted; and in that the notch includes a springy, elastic restraining element (33, 34) that co-acts with the string such as to hold the string releasably in the notch.

2. A bib according to claim 1, characterised in that an undercut part of the notch includes the restraining element which is intended to be received in a waist portion (52) located between two mutually sequential beads (51) in the string.

3. A bib according to claim 2, characterised in that the restraining element includes two separate parts (34) which are adapted to springily and yieldingly engage a respective waist portion, wherein said parts of the restraining element are spaced apart by a distance smaller than the diameter of a respective waist portion (52) and are located above the bottom of the notch (32) at a distance therefrom which is greater than the radius of the beads, when the beads rest on the bottom of said notch.

4. A bib according to claim 1, characterised in that the restraining element (33) extends through more than 180 degrees around a respective waist portion (52).

5. A bib according to claim 1, characterised in that the exposed surface of said body is hemispherical in shape.

6. A bib according to claim 5, characterised in that the extension of the hemispherical shape is somewhat greater than the outer diameter of the string.

7. A bib according to claim 1, characterised in that the fastener notch is generally parallel with the nearby free-bearing free end portion (56) of the string.

8. A bib according to claim 1, characterised in that the string is formed integrally with the front piece.

9. A bib according to claim 1, characterised in that the string has an end portion that has been extruded onto and around the edge of the recess to surround the same.

10. A bib according to claim 9, characterised in that the part of the string extruded around the edge of the recess has the form of a bead string.

* * * * *